United States Patent [19]

Matsui et al.

[11] 4,133,677

[45] Jan. 9, 1979

[54] PROCESS FOR PRODUCING ACICULAR MAGNETIC METALLIC PARTICLE POWDER

[75] Inventors: Goro Matsui; Koji Toda; Atushi Takedoi; Nanao Horiishi, all of Hiroshima, Japan

[73] Assignee: Toda Kogyo Corp., Hiroshima, Japan

[21] Appl. No.: 783,326

[22] Filed: Mar. 31, 1977

[30] Foreign Application Priority Data

Apr. 5, 1976 [JP] Japan ..... 51-39027
Jun. 14, 1976 [JP] Japan ..... 51-70231

[51] Int. Cl.[2] ..... C22C 1/04
[52] U.S. Cl. ..... 75/0.5 AA; 148/105; 423/633
[58] Field of Search ..... 423/632, 633, 634; 252/62.56, 62.59, 62.55; 75/0.5 AA; 148/105; 427/127, 216

[56] References Cited

U.S. PATENT DOCUMENTS

| | | | |
|---|---|---|---|
| 3,370,971 | 2/1968 | Linton | 106/308 B |
| 3,702,270 | 11/1972 | Kawasaki et al. | 75/0.5 AA |
| 3,843,349 | 10/1974 | Ehrreich et al. | 75/0.5 AA |
| 3,912,646 | 10/1975 | Leitner et al. | 423/634 |
| 3,947,502 | 3/1976 | Leitner et al. | 423/634 |
| 3,956,005 | 5/1976 | Sugahara et al. | 106/308 B |
| 4,043,846 | 8/1977 | Amemiya et al. | 148/105 |

FOREIGN PATENT DOCUMENTS

| | | | |
|---|---|---|---|
| 4883100 | 11/1973 | Japan. | |
| 4941299 | 4/1974 | Japan. | |
| 212240 | 5/1968 | U.S.S.R. | 423/633 |

*Primary Examiner*—O. R. Vertiz
*Assistant Examiner*—Wayne A. Langel

[57] ABSTRACT

The process for producing acicular magnetic metallic particle powder with improved magnetic properties which include the characteristic steps for producing the acicular particles of metal oxide with homogeneous and dense coats of crystalline silica and to thereby protect the particles from heat-damages during the reduction thereof under high temperatures.

7 Claims, 20 Drawing Figures

FIG. 1-A
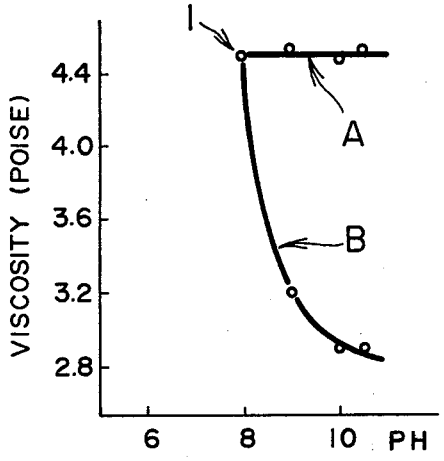
FIG. 1-B
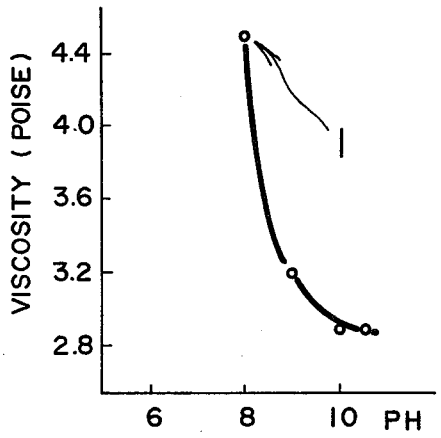
FIG. 2-A
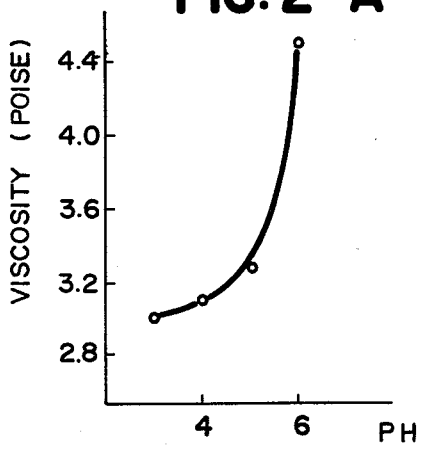
FIG. 2-B
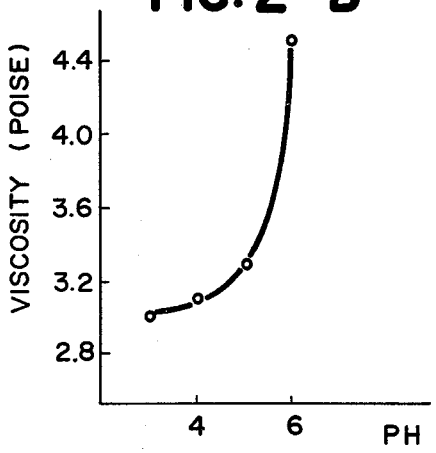
FIG. 3
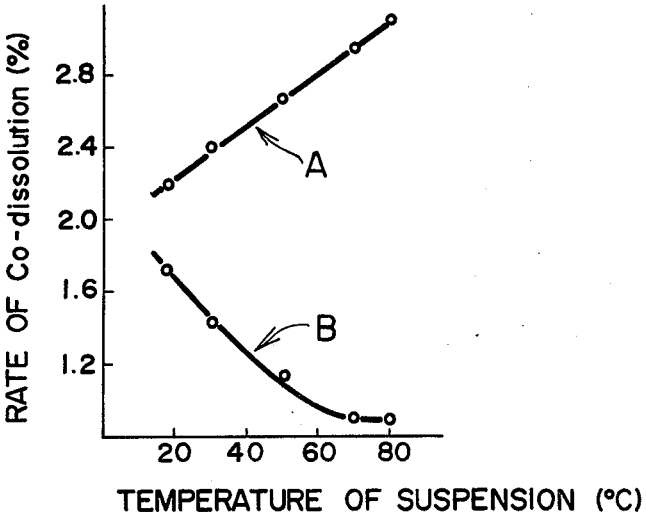

FIG. 4-A
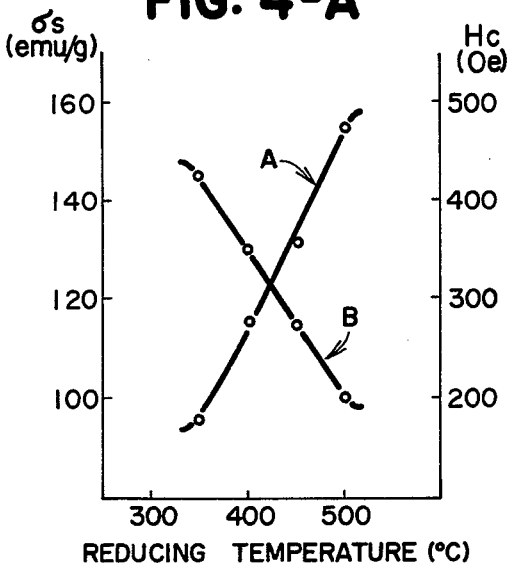
FIG. 4-B
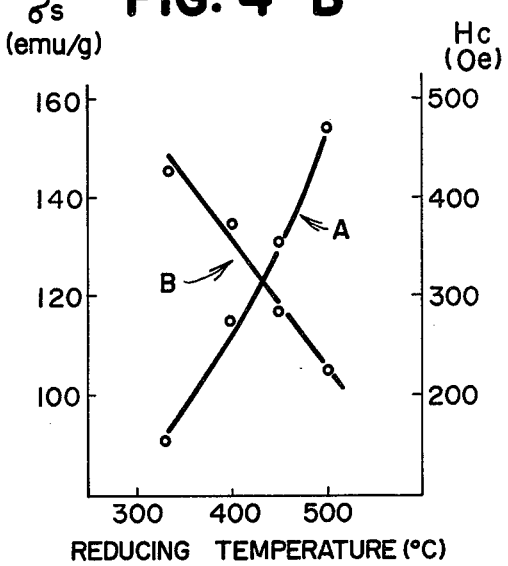
FIG. 5-A
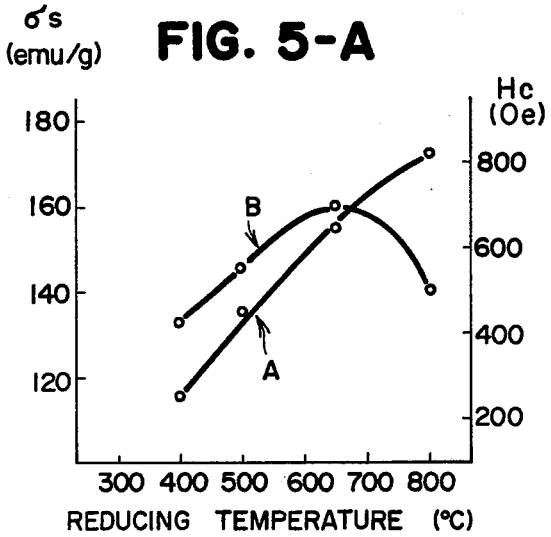
FIG. 5-B
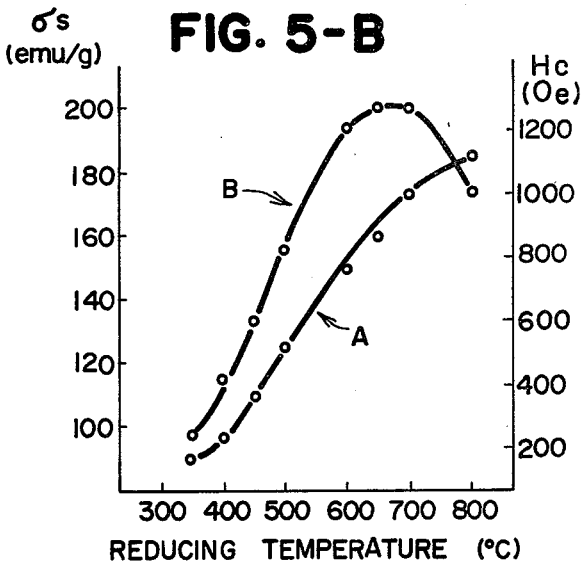
FIG. 6
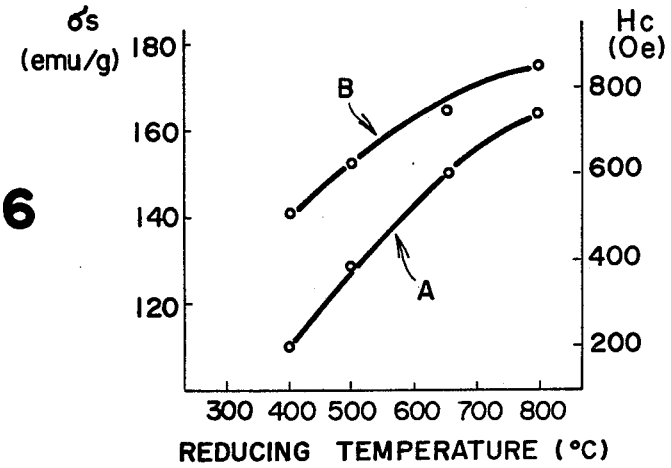

FIG. 7-A
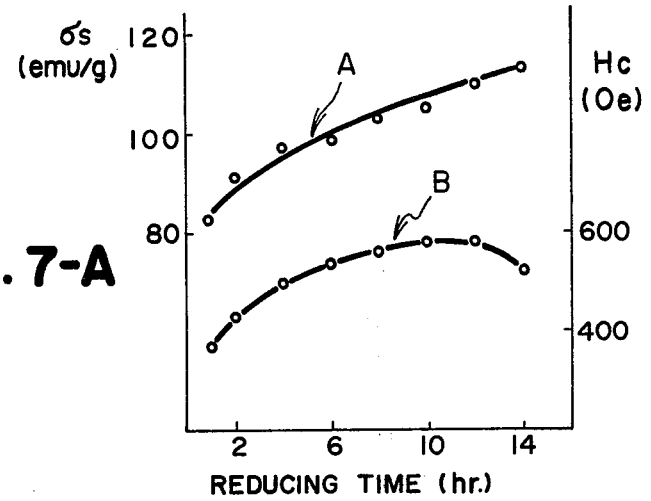
FIG. 7-B
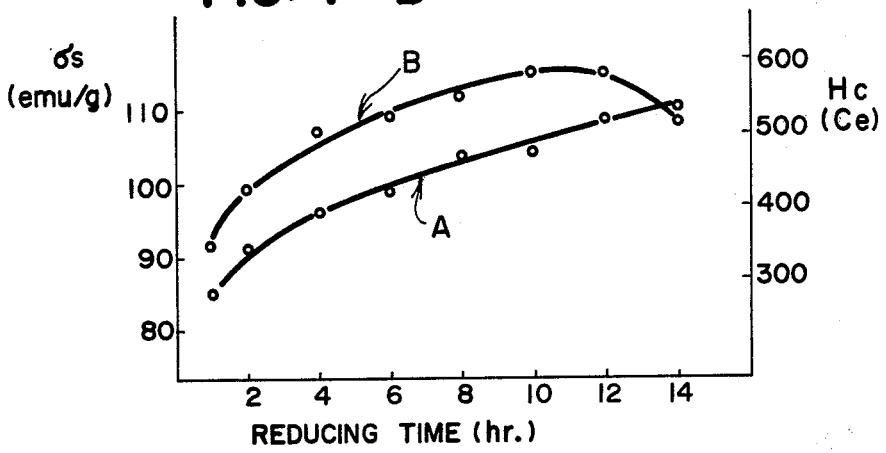
FIG. 8-A
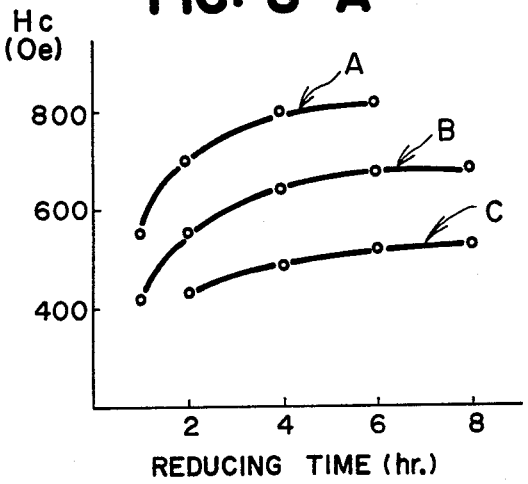
FIG. 8-B
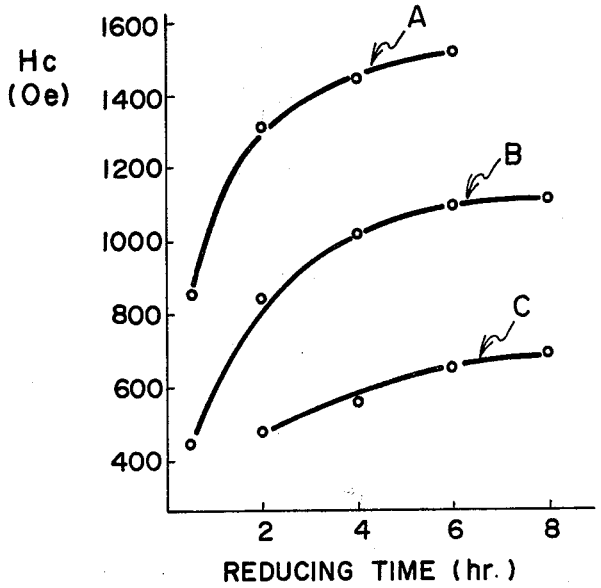

FIG. 9-A
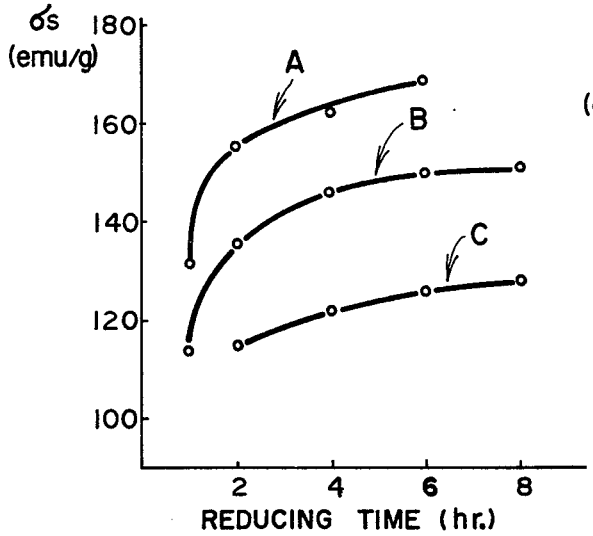
FIG. 9-B
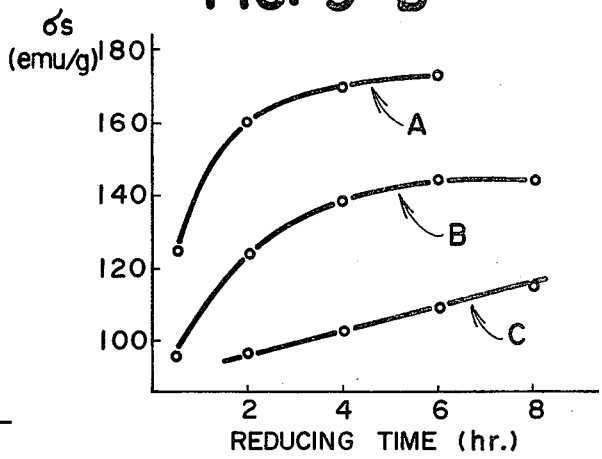
FIG. 10-A
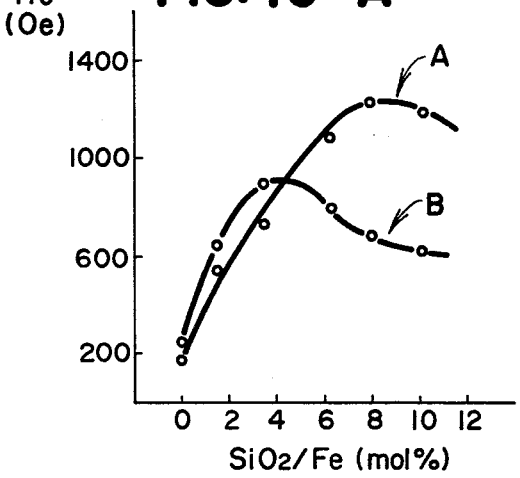
FIG. 10-B
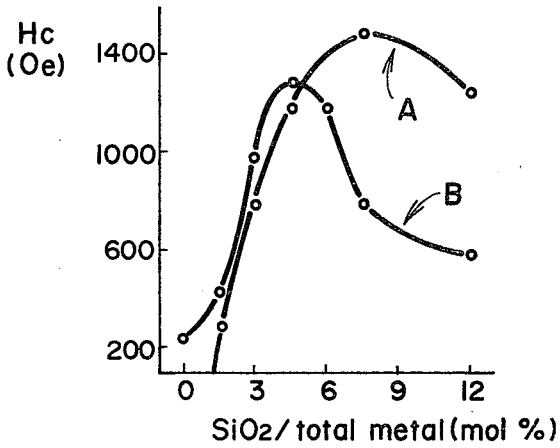
FIG. 11-A
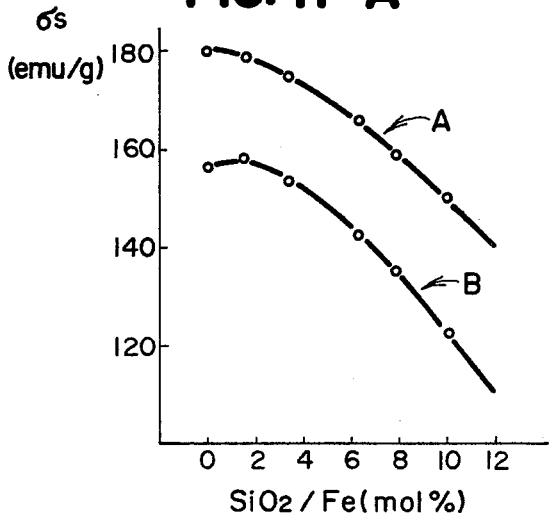
FIG. 11-B
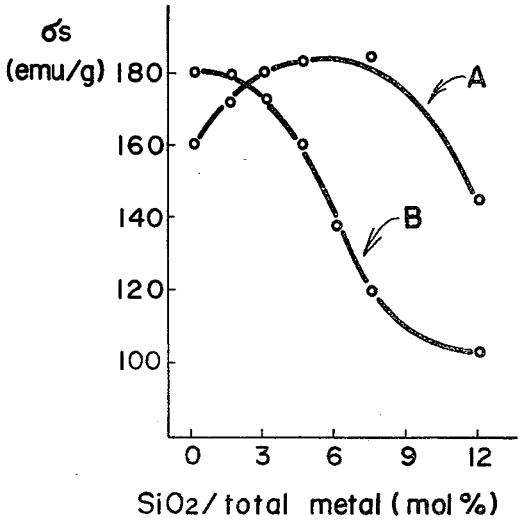

PROCESS FOR PRODUCING ACICULAR MAGNETIC METALLIC PARTICLE POWDER

BACKGROUND OF THE INVENTION

The present invention relates to improved processes for producing acicular magnetic metallic particle powder, more particularly to novel processes for producing the same most suitable for a magnetic material used for magnetic recording, which has a large saturated magnetic flux density δs (e.g. 90–200 emu/g) and a high coercive force Hc (e.g. 500–2000 Oe) and is in such a condition that no cross linking between the particles exists and so the particles are substantially independent from each other.

In recent years, a demand for a high efficiency of magnetic recording media has more and more increased with the progress in miniaturizing and lightening a reproducing apparatus for magnetic recording. Namely, it has been demanded to elevate a bit density, an output characteristic and especially a frequency characteristic of magnetic recording media. Therefore, a magnetic recording material must have a large saturated magnetic flux density and a high coercive force to satisfy the said demand.

By the way, the magnetic materials conventionally employed in magnetic recording media are magnetic metal oxide powder such as magnetite, maghemite and chromium dioxide, and each of these magnetic oxide type powder has 70–85 emu/g of saturated magnetic flux density δs and 250–500 Oe of coercive force Hc. And it is a main factor in limiting the level of reproducing output and bit density that δs of above magnetic oxide type particle powder is at most about 85 emu/g and generally 70–80 emu/g. Further, Co-magnetite or Co-maghemite magnetic powder, having been also used as a magnetic recording material, is characterized by a coercive force Hc as high as 400–800 Oe and on the contrary a saturated magnetic flux density δs as low as 60–70 emu/g.

On the other hand, instead of these magnetic oxide type powder, a development of magnetic non-oxide type particle powder having such properties as a larger saturated magnetic flux density and a still higher coercive force suitable for recording with both of high reproducing output and bit density, has been recently promoted. An acicular magnetic iron particle powder is one of examples having such properties as abovementioned.

A process generally known in the prior art to produce the acicular magnetic iron particle powder comprises reducing acicular iron (III) oxide hydroxide particles of acicular ferric oxide particles at a temperature as lower as possible than 350° C. in a stream of reducing gas. In the above-mentioned process the higher the heating temperature at the reduction in reducing gas, the larger the saturated magnetic flux density δs of acicular magnetic iron particle powder becomes. It is, however, ascertained that a deformation of the acicularity of this resultant magnetic iron particle powder and a sintering between said particle powder remarkably proceed in that degree. And, therefore, the coercive force Hc of the obtained acicular magnetic iron particle powder becomes extremely low, since the coercive force of acicular magnetic iron particle powder used as a magnetic recording material largely depends on a shape-anisotropy thereof. An acicularity of magnetic iron particle powder is one of the most important properties. Accordingly, in a process for producing acicular magnetic iron particle powder, it is important to form first of all as a starting material acicular, iron (III) oxide hydroxide particles or acicular ferric oxide particles having superior acicularity. After the formation of said particles, there arises a problem how to keep this acicularity in reducing the same while heating to produce acicular magnetic iron particle powder.

The shape of the particle is especially sensitive to the heating temperature, and the particle growth is so remarkable, particularly in reducing atmosphere, that the unit particle grows over the original size of the particle itself and the external shape of the particle itself is gradually deformed to cause a modification of the shape and a sintering between the particles. As the result, the coercive force is lowered. Thus, there has been arisen a serious difficulty that the condition for obtaining acicular magnetic iron particle powder having a high coercive force Hc, namely maintaining the low heating temperature when reducing, conflicts with the condition for obtaining acicular magnetic iron particle powder having a large saturated magnetic flux density δs, namely maintaining the high heating temperature when reducing.

On the other hand, the following processes are provided to prevent the sintering of magnetic particles in a process for producing magnetic oxide type particles such as acicular magnetic ferric oxide by means of laying $SiO_2$ on the particles (Japanese patent application laying open Nos. 83100/73 and 41299/74).

(A) A process comprising adjusting a suspension containing acicular iron (III) oxide hydroxide particles or acicular ferric oxide particles to an acid region, pH 4.0–6.5, and adding water-soluble silicate thereinto;

(B) A process comprising adjusting a suspension containing acicular iron (III) oxide hydroxide particles or acicular ferric oxide particles to over about pH 12 and adding water-soluble silicate thereinto while treating said particles through a hydrolysis of water-soluble silicate under oxidizing atmosphere.

However, the inventors of the present invention found that the above-mentioned processes (A) and (B) did not remove the aforementioned difficulty in producing acicular magnetic iron particle powder of non-oxide type. That is, as the result of thorough research, it is found that these known processes for laying $SiO_2$ on magnetic particles have following defects.

In the process (A), as soon as water-soluble silicate is added into the suspension, an immediate precipitation in the form of $SiO_2$ arises and it is easy to form a mixture of ferric oxide particles and $SiO_2$ particles. Accordingly, $SiO_2$ particles become to lie on the surface of ferric oxide particles unevenly, and the absorbability between $SiO_2$ particles and ferric oxide particles is weak. And, in the process (B), in the case that sodium silicate is used as water-soluble silicate, water-soluble sodium silicate is hydrolyzed to produce $Na_2Si_2O_5$ as shown in formula (1) below, and then $Na_2Si_2O_5$ is decomposed by the dissolved oxygen or oxygen gas to form a precipitation of $SiO_2$ particles as shown in formula (2) below. The resultant precipitated $SiO_2$ particles lie on the magnetic particles.

$$2Na_2SiO_3 + H_2O \rightleftarrows Na_2Si_2O_5 + 2NaOH \quad (1)$$

$$Na_2Si_2O_5 + \tfrac{1}{2}O_2 \rightarrow 2SiO_2 + 2NaO \quad (2)$$

However, this process for laying prepared $SiO_2$ particles on iron (III) oxide hydroxide particles through hydrolyzing water-soluble sodium silicate results in that the obtained $SiO_2$ particles laid on the magnetic particles are uneven and coerse similarly in the process (A) because of taking long time for the hydrolysis.

Further, in the both of said processes (A) and (B), the amount of $SiO_2$ actually laid on acicular iron (III) oxide hydroxide particles is just a little comparing with that of added water-soluble silicate calculated as the amount of $SiO_2$.

In fact, as shown in each example in the Japanese patent application laying open Nos. 83100/73 and 41299/74 the amount of $SiO_2$ laid on acicular iron (III) oxide particles equals to 2–3 wt.% of added water-soluble silicate calculated as the amount of $SiO_2$. This is because that the resultant $SiO_2$ precipitate is in the suspended state in the solution without being laid on acicular iron (III) oxide hydroxide therein to form a mixture of acicular iron (III) oxide hydroxide particles and $SiO_2$ particles, which are undesirable from the economical point of view, since most of the resultant $SiO_2$ particles do not lie on the surface of iron (III) oxide hydroxide particles and are in the state of the uneffective suspension.

SUMMARY OF THE INVENTION

Accordingly, an object of this invention is to provide novel processes for producing acicular magnetic metallic particle powder which has the remarkably improved magnetic properties, namely, the both of high δs and Hc values and commercially valuable use as high-power and -density magnetic recording media.

Another object of this invention is to provide economically advantageous processes for producing the above-mentioned magnetic product wherein total times of the process are effectively shortened.

Other objects of this invention will become more apparent from the following description.

The foregoing and other objects of this invention will be accomplished by the processes of this invention which are summarized below.

The process of this invention for producing acicular magnetic metallic particle powder comprises the steps of:

preparing an aqueous suspension of acicular particles of at least one metal oxide selected from the group consisting of ferric oxide, iron (III) oxide hydroxide and each of these ones containing Co and/or Ni therein while adjusting the pH of the suspension at a desired value higher than 8;

adding an amorphous water-soluble silicate into the suspension as fully agitated under non-oxidizing atmosphere and to thereby coat homogeneously and densely the acicular particles of metal oxide with the amorphous silicate;

water-washing, collecting and drying the resultant particles and to thereby obtain the acicular particles of metal oxide as homogeneously and densely coated with the crystalline silica; and subsequently heating the same in a stream of a reducing gas at temperatures between 400°–800° C. and to thereby obtain acicular magnetic metal particle powder.

The another process of this invention for producing acicular magnetic metallic particle powder comprises the steps of:

preparing an aqueous suspension of acicular particles of at least one metal oxide selected from the group consisting of ferric oxide, iron (III) oxide hydroxide and each of these ones containing Co and/or Ni therein while adjusting the pH of the suspension at a desired value higher than 8;

adding an amorphous water-soluble silicate into the suspension as fully agitated under non-oxidizing atmosphere and to thereby coat homogeneously and densely the acicular particles of metal oxide with the amorphous silicate;

neutralizing the resultant amorphous silicate on the particles by adding an acid into the suspension and to thereby obtain the acicular particles of metal oxide as homogeneously and densely coated with the crystalline silica;

water-washing, collecting and drying the resultant particles, and subsequently heating the same in a stream of a reducing gas at temperatures between 400°–800° C. and to thereby obtain acicular magnetic metal particle powder.

BRIEF DESCRIPTION OF THE DRAWINGS

FIG. 1-A is a graph showing the relation between the pH of the suspension containing acicular iron (III) oxide hydroxide particle powder and the viscosity thereof;

FIG. 1-B is a graph showing the relation between the pH of the suspension and the viscosity thereof, which suspension contains water, acicular iron (III) oxide hydroxide particle including Co and sodium silicate;

FIG. 2-A is a graph showing the relation between the pH of the suspension and the viscosity thereof at neutralizing with $H_2SO_4$ the sodium silicate therein which coats the surface of acicular iron (III) oxide hydroxide particle;

FIG. 2-B is a graph showing the relation between the pH of the suspension and the viscosity thereof at neutralizing with $H_2SO_4$ the sodium silicate therein which coats the surface of acicular iron (III) oxide hydroxide particle including Co;

FIG. 3 is a graph showing the relation between the temperature of the suspension and the amount of Co-dissolution at pH4, which suspension contains acicular iron (III) oxide hydroxide particles including Co;

FIG. 4-A is a graph showing the relation between the magnetic properties of the resultant particle powder and the reducing temperature when reducing the acicular iron (III) oxide hydroxide particle at some temperature for two hours;

FIG. 4-B is a graph showing the relation between the magnetic properties of the resultant particle powder and the reducing temperature when reducing the acicular iron (III) oxide hydroxide particle including Co at some temperatures for two hours;

FIG. 5-A is a graph showing the relation between the magnetic properties of the resultant particle powder and the reducing temperature when reducing the acicular iron (III) oxide hydroxide particle coated with 4.5 mol% of silica at some temperatures for two hours;

FIG. 5-B is a graph showing the relation between the magnetic properties of the resultant particle powder and the reducing temperature when reducing the acicular iron (III) oxide hydroxide particle including Co and being coated with 4.5 mol% of silica for two hours;

FIG. 6 is a graph showing the relation between the magnetic properties of the resultant particle powder and the reducing temperature when reducing the acicular iron (III) oxide hydroxide particle including 0.3 atomic % of Cr and being coated with 4.5 mol% of silica at some temperatures for two hours;

FIG. 7-A is a graph showing the relation between the magnetic properties of the resultant particle powder and the reducing time when reducing the acicular iron (III) oxide hydroxide particle at 350° C., in which curve A indicates a saturated magnetic flux density and curve B indicates a coercive force;

FIG. 7-B is a graph showing the relation between the magnetic properties of the resultant particle powder and the reducing time when reducing the acicular iron (III) oxide hydroxide particle including Co at 350° C., in which curve A indicates a saturated magnetic flux density and curve B indicates a coercive force;

FIG. 8-A is a graph showing the relation between the coercive force of the resultant particle powder and the reducing time when reducing the acicular iron (III) oxide hydroxide particle coated with 4.5 mol % of silica at 600° C., 450° C. and 400° C., in which curves A, B and C indicate the relation at 600° C., 450° C. and 400° C. respectively;

FIG. 8-B is a graph showing the relation between the coercive force of the resultant particle powder and the reducing time when reducing the acicular iron (III) oxide hydroxide particle including Co and being coated with 4.5 mol % of silica at 650° C., 500° C. and 400° C., in which curves A, B and C indicate the relation at 650° C., 500° C. and 400° C. respectively;

FIG. 9-A is a graph showing the relation between the saturated magnetic flux density of the resultant particle powder and the reducing time when reducing the acicular iron (III) oxide hydroxide particle coated with 4.5 mol % of silica at 600° C., 450° C. and 400° C., in which curves A, B and C indicate the relation at 600° C., 45020 C. and 400° C. respectively;

FIG. 9-B is a graph showing the relation between the saturated magnetic flux density of the resultant particle powder and the reducing time when reducing the acicular iron (III) oxide hydroxide particle including Co and being coated with 4.5 mol% of silica at 650° C., 500° C. and 400° C., in which curves A, B and C indicate the relation at 650° C., 500° C. and 400° C. respectively;

FIG. 10-A is a graph showing the relation between the coercive force of the resultant particle powder and the amount of silica coat thereof when reducing the acicular iron (III) oxide hydroxide particle coated with the silica at 600° C. for 6 and 2 hours, in which curves A and B indicate the relation in 6 and 2 hours respectively;

FIG. 10-B is a graph showing the relation between the coercive force of the resultant particle powder and the amount of silica coat thereof when reducing the acicular iron (III) oxide hydroxide particle coated with the silica including Co at 650° C. for 8 and 2 hours, in which curves A and B indicate the relation in 8 and 2 hours respectively;

FIG. 11-A is a graph showing the relation between the saturated magnetic flux density of the resultant particle powder and the amount of silica coat thereof when reducing the acicular iron (III) oxide hydroxide particle coated with the silica at 600° C. for 6 and 2 hours, in which curves A and B indicate the relation in 6 and 2 hours respectively; and FIG. 11-B is a graph showing the relation between the saturated magnetic flux density of the resultant particle powder and the amount of silica coat thereof when reducing the acicular iron (III) oxide hydroxide particle coated with the silica including Co at 650° C. for 8 and 2 hours, in which curves A and B indicate the relation in 8 and 2 hours respectively.

DETAILED DESCRIPTION

Under the aforementioned situations in the art, we have carried out researches for years for producing acicular magnetic metallic particles in which reduction of acicular metal oxide particles can be conducted at a high temperature while without accompanying any decrease of Hc values of resultant magnetic metallic particles.

As a result of our researches, it has been found that in the case where acicular metal oxide particles are more evenly coated with homogeneous and dense silica ($SiO_2$) coats, the particles can be effectively protected from the aforementioned heat-damages during the reduction thereof at higher temperatures and further the very even and dense silica ($SiO_2$) coats on the particles can be easily formed by previously coating the particles with amorphous water-soluble silicate under the critical conditions as excluded a hydrolytic and oxydative decomposition of amorphous silicate into uneven and rough silica grains and thereafter followed by converting the silicate coats on the particles into even and dense silica ($SiO_2$) coats.

Based on these findings, we have accomplished the process of this invention briefly summarized above.

First of all, the most important process in the present invention, namely the process for coating the surface of acicular particles of metal oxide with amorphous water-soluble silicate under the condition that the amorphous water-soluble silicate is not hydrolyzed nor decomposed by oxidation, will be described with reference to the detailed data.

For preventing the hydrolysis and the oxidative decomposition of water-soluble silicate, it is necessary to treat the particle of metal oxide with the amorphous water-soluble silicate aqueous solution efficiently in short time in an alkaline region under non-oxidizing atmosphere. This treatment of the particles under the non-oxidizing atmosphere prevents the reaction of formula (2) and accordingly prevents the hydrolytic reaction of formula (1).

FIG. 1-A shows the relation between a pH value of the suspension containing acicular iron (III) oxide hydroxide particles and a viscosity thereof. In FIG. 1-A, the number 1 shows the viscosity of the suspension obtained by dispersing acicular iron (III) oxide hydroxide particles in water. The curve A shows the relation between the pH value of the suspension and the viscosity thereof after suspending the acicular iron (III) oxide hydroxide particles in water and adding caustic soda to adjust the pH value. The curve B shows the relation between the pH value of the suspension and the viscosity thereof when the sodium silicate is added into the suspension of the curve A under non-oxidizing atmosphere to adjust the pH value. As shown in the curve A, the viscosity of the suspension including no sodium silicate scarcely lowers in the region of the pH value higher than 8, while as shown in the curve B the viscosity of the suspension after being added with sodium silicate suddenly lowers in that region and to obtain a suspension with lower viscosity. Therefore the suspension of the curve B enables the amorphous sodium silicate and the particles of metal oxide to disperse evenly therein and to thereby obtain the particles homogeneously and finely coated with the sodium silicate.

Accordingly, in the suspension of the curve B in FIG. 1-A the starting material particles are effectively treated in short time without causing the hydrolysis of the silicate if treating with the amorphous water-soluble silicate and under non-oxidizing atmosphere. Furthermore, it is possible to hold the starting particles in a fully dispersed state in the amorphous water-soluble silicate aqueous solution, so the surface of particles can be evenly and fully coated with the amorphous water-soluble silicate.

Similarly, FIG. 1-B showing the relation between a pH value and a viscosity of the suspension containing particles coated with sodium silicate, which is prepared by suspending acicular iron (III) oxide hydroxide particles including Co in water and then adding sodium silicate thereinto, indicates the variation both of the pH and the viscosity when sodium silicate is added under non-oxidizing atmosphere. From FIG. 1-B it is found that the suspension has the low viscosity at the pH value higher than 8 and to obtain an even dispersion of the amorphous sodium silicate and the suspending particles and also to obtain the particles homogeneously and densely coated with the sodium silicate.

The number 1 in FIG. 1-B indicates the viscosity of the suspension when admixing and dispersing the starting material particles of metal oxide into water.

By the way, the viscosity in FIG. 1-A and FIG. 1-B was measured by the use of a Stormer's viscometer.

The amorphous silicate coats on the metal oxide particles obtained in the above-mentioned manner are converted to the crystalline silica coats by the subsequent steps of water-washing, collecting and drying the resultant particles or by the neutralization with a suitable acid such as $H_2SO_4$ and HCl.

By the way, said water-washing may be applied to the particles precipitated and collected by decantation or the particles recovered and collected by the filtration under a reduced pressure. Of course, in the case of said neutralization with the acid the water-washing is necessary after the neutralization to eliminate the resulting unnecessary salt.

FIG. 2-A shows the variation of pH value and viscosity when $H_2SO_4$ is added into the suspension containing acicular iron (III) oxide hydroxide particles coated with sodium silicate to neutralize said sodium silicate and to thereby obtain the particles coated with silica. From FIG. 2-A it is found that the suspension has a low viscosity in the region of the pH value of lower than 5 after the neutralization. This neutralizing reaction is formulated in formula (3).

$$Na_2SiO_3 + H_2SO_4 \rightarrow SiO_2 + Na_2SO_4 + H_2O \quad (3)$$

As the above neutralizing reaction proceeds in short time, finely divided particles of silica is produced and to thereby obtain the acicular particles coated therewith. Further, said silica particles evenly coat the surface of the acicular particles because the surfaces are evenly coated with the amorphous water-soluble silicate.

Furthermore, as most of the amorphous water-soluble silicate added into the suspension coat the surface of acicular iron (III) oxide hydroxide particles (or acicular ferric oxide particles) in advance and said silicate is converted to silica on those particles, so free particles of silica scarcely exists and all the particles of silica coat the surface of metal oxide particles.

FIG. 2-B shows the variation of pH value and viscosity similarly to FIG. 2-A but the starting material particles are acicular iron (III) oxide hydroxide containing Co. As is the same with FIG. 2-A, the viscosity of the suspension lowers when the pH value decreases lower than 5 by the neutralization.

By the way, in the case that the starting acicular particles of metal oxide contain such metal as Co and/or Ni other than Fe, the suspension containing said particle becomes an acidic suspension with the pH value lower than 5 due to the neutralizing reaction of the formula (3), in which arising the dissolution of Co and/or Ni metal contained in said particle. This dissolution was studied through experiments by using the suspension with pH4 and the results are shown in FIG. 3. From the line A in FIG. 3 it is found that in the case of the particles having been coated with no silica Co-dissolution is increased in a straight line in proportion to the rise of the temperature of the suspension. On the contrary, as is shown in the curve B, it is surprising that in the case of the particles having been coated with silica Co-dissolution is decreased in proportion to the rise of the temperature of the suspension. Therefore, in the present invention the dissolution of Co and/or Ni can be prevented by carrying out the neutralizing reaction at a high temperature and a stable component composition of the resultant metallic particles can be obtained. In this case, not similarly to the aforementioned cases of the prior art, free and rough particles (grains) of silica are not produced within the suspension and all the fine particles of silica can be tightly formed only on the surface of metal oxide particles as their coating layers. Thus, the metallic particles obtained after accomplishing reduction step can retain the acicularity of the starting particles and therefore can be provided with the both of high δs and Hc values.

Meanwhile, with the change of the specific gravity during the reducing process from oxide to metal, the volume of the produced acicular metallic particle is gradually shrinking, and therefore the starting particles must be chosen in due consideration to this shrinkage of the particle volume. Accordingly, it is important that the acicularity and the size of starting particles are chosen previously to be adapted to the magnetic properties of final product to be produced. The inventors of the present invention have long been engaged in the production of acicular metal oxide particles and have already developed various processes to obtain metal oxide particles having superior acicular crystals (average axis ratio; more than 15:1 or still further more than 20:1). Several preferred processes are described as below.

(1) Iron (III) oxide hydroxide particles having superior acicularity (average axis ratio; more than 15:1) can be produced by the process comprising preparing a ferrous salt solution, adding an alkali in an amount of more than stoichiometrically equivalent to that of ferrous salt into said solution at a temperature between 40–55° C. under non-oxidizing atmosphere and to thereby obtain a solution having a pH of higher than 11 and containing a ferrous precipitate therein, thereafter oxidizing said ferrous precipitate by introducing an oxidizing gas into the resultant solution as maintained at a temperature lower than 50° C., and subsequently water-washing, collecting and drying the resultant particles of iron (III) oxide hydroxide.

In the abovementioned process for producing iron (III) oxide hydroxide particles with superior acicularity, if ferrous hydroxide is precipitated at a temperature of lower than 40° C., it is impossible to obtain iron (III) oxide hydroxide particles having superior acicularity (average axis ratio; more than 15:1) in the following steps. At a temperature of higher than 55° C., granular megnetite particles come to be blended into the ferrous hydroxide precipitate. When the oxidizing reaction is carried out at a temperature of higher than 50° C., granular magnetic particles come to be blended into the iron (III) oxide hydroxide precipitate.

(2) Ferric oxide particles having superior acicularity can be produced by heating the iron (III) oxide hydroxide particles obtained in the preceding process (1). To be more precise, acicular α-hematite particles are prepared by heating and dehydrating the iron (III) oxyde hydroxide particles obtained in the process (1), acicular magnetite particles are prepared by heating and reducing the same, and acicular maghemite particles are prepared by heating and reoxidizing the same. These oxide particles have also superior acicularity. Therefore, it these acicular particles are used as the starting material of the present invention, acicular magnetic iron particle powder having superior magnetic properties can be obtained.

(3) Furthermore, in the process (1), if the ferrous salt solution contains 0.01–1 atomic % of Cr based on the amount of Fe therein, iron (III) oxide hydroxide particles having superior acicularity and including Cr can be obtained. Cr included in the acicular particles of iron (III) oxide hydroxide is known to effect a restraint upon the growth of the acicular particles and to thereby prevent the deformation of the particles and the sintering between the particles during the reducing thereof as heating in the reducing gas.

Therefore, in the case that the acicular iron (III) oxide hydroxide particles including Cr or the acicular ferric oxide particles including Cr, which is prepared by the heat-treatment of the former are used as starting materials, the superior magnetic properties such higher saturated magnetic flux density and higher coercive force can be obtained as shown in FIG. 6 in comparison with those of the particle including no Cr. This is because of the synergetic effects of Cr and silica with the restraining effect upon the growth of the metallic particles.

The synergetic effects as mentioned above is not remarkable where the Cr-content is less than 0.01 atomic % based on the amount of Fe-content. While more than 1 atomic % of Cr-content has a restraining effect upon the growth of particles as well, less than 1 atomic % of Cr-content is fully enough to satisfy the objects of the present invention.

(4) Iron (III) oxide hydroxide particles having a superior acicularity (average axis ratio; more than 20:1) and containing Co and/or Ni can be produced by the process comprising, similarly to the process (1), preparing a ferrous salt solution with containing 0.1–10 atomic % of Co and/or Ni based on the amount of Fe component therein, adding an alkali in an amount of more than stoichiometrically equivalent to that of the ferrous salt into said ferrous salt solution at a temperature between 40–55° C. under non-oxidizing atomosphere and to thereby obtain a solution having a pH value of higher than 11 and containing a ferrous precipitate therein with homogeneously containing Co and/or Ni, thereafter oxidizing said ferrous precipitate by introducing an oxidizing gas into the resultant solution as maintained at a temperature lower than 50° C., then water-washing, collecting and drying the resultant particles of iron (III) oxide hydroxide. In this process (4), if the amount of Co- and/or Ni-content based on the Fe-content is less than 0.1 atomic %, it is impossible to improve the magnetic properties of acicular magnetic Fe-Co or Fe-Co-Ni alloy particle powder.

If the amount of Co- and/or Ni-content is more than 10 atomic %, the acicularity of the magnetic alloy particles decays.

(5) Ferric oxide particles containing Co and/or Ni and having superior acicularity can be produced by heating the particles obtained in the preceding process (4). To be more precise, acicular hematite particles containing Co and/or Ni are prepared by heating and dehydrating the iron (III) oxide hydroxide particles obtained in the process (4), acicular magnetite particles containing Co and/or Ni are prepared by heating and reducing the same, and acicular maghemite particles containing Co and/or Ni are prepared by reducing and reoxidizing the same. These metal oxide particles have also superior acicularity, which therefore very appropriate to be used as the starting materials of the present invention.

And also these particles in the process (4) and (5) may contain 0.01–1 atomic % of Cr based on the Fe-content therein similarly in the process (2).

Needless to say, the starting materials of the present invention are not limited to each acicular particles obtained by said processes (1)–(5) but may be chosen from the metal oxide particles with an appropriate acicularity and a proper size, which may be produced by various other processes, on considering the shrinkage of the particle volume during the reducing step.

As mentioned before, convertionally in the art acicular magnetic iron particle powder is obtained by heating acicular iron (III) oxide hydroxide particles or acicular ferric oxide particles at a temperature as low as possible (lower than 350° C.) under the atmosphere of reducing gas with a high partial pressure. Therefore, it takes a long time and a large amount of reducing gas until the ferric oxide particles are reduced to the acicular magnetic iron particles. This is the result of paying regard to the acicular of the starting material particles.

On the contrary, by the process of present invention acicular magnetic metallic particle powder having superior acicularity can be obtained in short time.

FIG. 4-A shows the magnetic properties of the resultant particle powder in the case that acicular iron (III) oxide hydroxide particle powder is reduced at some temperatures from 350° C. to 500° C. in a stream of $H_2$ gas for 2 hours. The curve A in FIG. 4-A indicates that the saturated magnetic flux density δs increases with the rise of the reducing temperature. On the contrary, the curve B indicates that the coercive force Hc decreases with the rise of the reducing temperature. Thus, in conventional processes acicular magnetic iron particle powder was used to be produced at a reducing temperature as low as possible.

FIG. 5-A shows the magnetic properties of the produced particle powder obtained by reducing acicular iron (III) oxide hydroxide particle powder coated with 4.5 mol % of silica in a stream of $H_2$ gas at each temperature between 400° C.–800° C. for 2 hours.

In FIG. 5-A, curves A and B are related to the saturated magnetic flux density δs, and the coercive force Hc respectively, showing that both properties tend to increase with the rise of the reducing temperature, in a quite different way from the conventional process as shown in FIG. 4A.

FIG. 6 shows the magnetic properties of the particle powder produced by reducing acicular iron (III) oxide hydroxide particle powder coated with 4.5 mol % of silica and containing 0.3 atomic % of Cr in $H_2$ stream at each reducing temperature between 400° C.–800° C. for 2 hours. In FIG. 6, curves A and B are related to the saturated magnetic flux density δs and the coercive force Hc respectively. As seen from the figure, the coercive force Hc does not lower even at a reducing temperature of 800° C., thereby the fact indicating an excellent synergetic effects provided by the combination of silica coats and Cr.

FIG. 7-A shows the magnetic properties of the particle powder produced by reducing acicular iron (III) oxide hydroxide particle powder in $H_2$ stream at a reducing temperature of 350° C. for each reducing period between 1–14 hours. In FIG. 7-A, curves A and B are related to the saturated magnetic flux density δs and the coercive force Hc, and the both describe their change at each reducing time as showing that long times are required in order to attain their values to maximum ones because of the low reducing temperature.

FIG. 8A and FIG. 9-A show the magnetic properties of the particle powder produced by reducing acicular iron (III) oxide hydroxide particle powder coated with 4.5 mol % of silica in $H_2$ stream at each reducing temperature of 400° C., 450° C., and 600° C. for each period between 1–8 hours. FIG. 8-A is related to the coercive force Hc, and FIG. 9-A is related to the saturated magnetic flux density δs. In FIG. 8-A and FIG. 9-A, each curve A, B and C represents the magnetic properties of the powder at a reducing temperature of 600° C., 450° C. and 400° C. respectively, showing that both Hc and δs reach their maximum values in shorter time and their values increase more as the reducing temperature becomes higher.

FIG. 10-A and FIG. 11-A show the magnetic properties of the particle powder produced by reducing each acicular iron (III) oxide hydroxide particle powder coated with 0–12 mol % of silica in $H_2$ stream at a reducing temperature of 600° C. for 2 hours and for 6 hours, respectively. FIG. 10-A is related to the coercive force Hc, and FIG. 11-A is related to the saturated magnetic flux density δs. In both figures, the curves A and B shows the magnetic properties at reducing times of 6 hours and 2 hours, respectively. As seen from the figures, the magnetic properties Hc and δs are influenced by the temperature and reducing times depend on the amount of silica coats. This fact indicates that the coercive force Hc and the saturated magnetic flux density δs can be simultaneously increased if the reducing temperature and times are properly selected in correlation with the amount of silica coats.

On the other hand, FIG. 4-B shows the magnetic properties of the particle powder produced by reducing acicular iron (III) oxide hydroxide particle powder containing Co having 2.7 atomic % Co against Fe in $H_2$ gas stream at each temperature between 330° C.–500° C. for 2 hours. In the figure, curve A indicates that the saturated magnetic flux density δs increases with the rise of reducing temperature, contrary to which, curve B indicates that the coercive force Hc decreases with the rise of reducing temperature. Thus, in conventional process, acicular iron-alloy magnetic particle powder containing Fe-Co as its main components is obliged to be produced under as low reducing temperature as possible.

FIG. 5-B shows the magnetic properties of the particle powder produced by reducing acicular iron (III) oxide hydroxide particle powder coated with 4.5 mol % of silica and containing 2.7 atomic % of Co based on Fe component contained therein in $H_2$ stream at each reducing temperature between 350° C.–800° C. for 2 hours. In the figure, curves A and B are related to the saturated magnetic flux density δs and the coercive force Hc respectively, and both properties tend to increase with the rise of reducing temperature. This phenomenon is quite different from the conventional example shown in FIG. 4.

FIG. 7-B shows the magnetic properties of the particle power produced by reducing acicular iron (III) oxide hydroxide particle powder containing 2.7 atomic % of Co based on Fe component contained therein in $H_2$ stream at a reducing temperature of 330° C. for each period between 1–14 hours. In the figure, change of the saturated magnetic flux density δs and coercive force Hc according to each reducing period are indicated by curves A and B respectively, and showing that long times are required for both properties to attain their values to maximum ones because of low reducing temperatures.

FIG. 8-B and FIG. 9-B show the magnetic properties of the particle powder produced by reducing acicular iron (III) oxide hydroxide particle powder containing 2.7 atomic % of Co based on Fe component contained therein in $H_2$ stream at each reducing temperature of 400° C., 500° C. and 650° C. for each reducing period between 0.5–8 hours. FIG. 8-B and 9-B are related to the coercive force Hc and the saturated magnetic flux density δs, respectively.

In the figures, curves A, B and C are representing the magnetic properties measured at a temperature of 650° C., 500° C. and 400° C. respectively, and showing that the maximum values thereof can be attained in shorter times and the values increase more as the reducing temperature becomes higher. FIG. 10-B and 11-B shows the magnetic properties of the particle powder produced by reducing the acicular iron (III) oxide hydroxide particle powder which contains 2.7 atomic % of Co based on the amount of Fe-content therein and is coated with 0–12 mol % of silica calculated the amount of $SiO_2$ based on the amount of the total metal, at the reducing temperature of 650° C. for 2 and 8 hours in a stream of $H_2$ gas. FIG. 10-B and 11-B represent the coercive force Hc and the saturated magnetic flux density δs respectively. In FIG. 10-B and 11-B, curves A and B represent the magnetic properties of the particle reduced for 8 and 2 hours respectively. As shown by curves A and B in FIG. 10-B and 11-B, the properties of Hc and δs are influenced by the temperature and the reducime time depended on the amount of silica coat, which indicates that the coercive force Hc and the saturated magnetic flux density δs can be increased simultaneously if the reducing temperature, the time and the amount of silica coat are appropriately selected.

Followingly, the various conditions for carrying out the process of the present invention will be mentioned.

In the present invention, iron (III) oxide hydroxide particles mean acicular α-, β-, γ- iron (III) oxide hyroxide particles, and acicular ferric oxide particles mean acicular hematite particles, magnetite particles, and maghemite particles. (Same can be applied to those containing Co and/or Ni). As water-soluble silicate used in the present invention, sodium silicate and potassium silicate are employed. In the present invention, water-soluble silicate is added into a suspension containing the starting material particles at a pH value higher than 8 because an effective treatment in short time is desired so as not to cause the hydrolytic reaction and also because the starting material particles must be dispersed fully at a low viscosity to coat the surface of particles with the amorphous water-soluble silicate homogeneously and fully. Where pH is lower than 8, as is obvious from the FIG. 1-A or 1-B, the viscosity increases and the treatment cannot be carried out effectively as the hydrolytic reaction easily occurs and thereby bringing about difficulties in dispersing the particles homogeneously and fully.

In order to prevent the progress of the hydrolitic reaction, the step of the addition of silicate in the present invention is carried out under the non-oxidizing atmosphere. In the case that the amorphous water-soluble silicate coat is less than 1 mol % calculated as the $SiO_2$ amount based on the Fe amount, the object of the present invention can not be enoughly satisfied and in the case more than 15 mol %, the saturated magnetic flux density decreases due to the lowering of the purity although the superior acicularity can be obtained.

In the present invention, $H_2SO_4$, HCl, etc. are employed as an acid for the neutralization.

In the present invention, the reducing reaction does not smoothly progress if the reducing temperature in a reducing gas is lower than 400° C., and if the temperature is higher than 800° C. the reducing reaction radically progresses bringing about the deformation of the acicular particles and the sintering between the particles. Moreover, as highly refined arrangements and skilled techniques are required for the reduction at a temperature as high as 800° C. in a reducing gas, which is not desirable from the economical and industrial viewpoints.

Considering the progress of the reducing reaction, the shape of the particles, the sintering between the particles, the industrial materials and the industrial arrangements, the heating temperatures higher than 450° C. and less than 700° C. are preferred. In the case that the starting materials contain Cr, it is sometimes preferable to raise the reducing temperature up to around 800° C.

Followingly, the advantages of the present invention will be summarized below.

In the present invention, it is possible to obtain acicular magnetic metallic particle powder which keeps the shape of the starting material and, for example, is substantially independent to each other without no cross linking between the particles. Acicular magnetic metallic particle powder thus obtained can be used as the magnetic recording material having high reproducing output and a high bit density which nowadays is most wanted as it has a large saturated magnetic flux density $\delta s$, e.g. 90–200 emu/g and a high coercive force from 500 Oe 2000 Oe.

Further, in the present invention, as acicular magnetic metallic particle powder can be obtained by a reduction at a reducing temperature higher than 400° C. in short time, it is economical and industrially desirable from the viewpoints of the arrangements and the manufacture.

Other advantages of the process according to the present invention will be understood by those skilled in the art from the following examples.

By the way, in the examples and the comparison examples the amount of $SiO_2$ and Cr was measured by Si analysis of JISG1212 and atomic adsorption analysis respectively. And the viscosity was measured by a Stormer's viscometer.

PREPARATION OF STARTING MATERIAL PARTICLES

EXAMPLE 1

42 l of aqueous solution containing 52 mol of $FeSO_4$ was added into 18 l of 15.2N NaOH aqueous solution previously placed in a reactor, while introducing $N_2$ gas thereinto at a flow rate of 200 l/min.. This procedure was continued for 15 minutes at pH 12.2 and at a tempereture of 48° C. to form ferrous hydroxide colloid. Thereafter, air introduced at a flow rate of 300 l/min. into the resulting colloidal solution at 40° C. to carry out oxidizing reaction for 20 hours, thereby obtaining acicular iron (III) oxide hydroxide particles. Subsequently, the obtained particles were washed with water, filtered, dried, and ground in usual manner. These resultant particles were acicular $\alpha$-FeOOH by a chemical analysis and were acicular particles having 0.8–1.0$\mu$ of long axis and 15:1 axial ratio of long axis to short axis by electro-microscopic observation.

EXAMPLE 2

20 l of aqueous suspension containing 2.6 mol of fine divided $\alpha$-FeOOH particles as a seed and 17.4 mol of FeSO4 was heated to maintain the temperature of the suspension at 68° C. while introducing air at a flow rate of 100 l/min.. 5l of 3.58-N NaOH aqueous solution was gradually poured into said suspension so at to control the pH value thereof at 4.0 and to thereby obtain acicular iron (III) oxide hydroxide particles. The resultant particles were washed with water, filtered, dried, and ground in usual manner. According to a chemical analysis and electromicroscopic observation, these particles thus obtained were $\alpha$-FeOOH particles which were acicular and had 0.5–0.7$\mu$ of long axis and 15:1 of axial ratio of long axis to short axis.

EXAMPLE 3

14 l of aqueous admixture consisting of $Cr_2(SO_4)_3$ aqueous solution containing 0.045 mol of Cr and $FeSO_4$ aqueous solution containing 15 mol of Fe was added into 6 l of 11.55-N NaOH aqueous solution previously placed in a reactor. And thereby the formation of ferrous hydroxide colloid containing Cr was carried out for 15 minutes at pH 12.5 and at a temperature of 45° C. while introducing $N_2$ gas at a flow rate of 200 l/min.. Thereafter air was introduced at a rate of 300 l/min. into the resulting colloidal solution at 45° C. to carry out oxydizing reaction for 14 hours, thereby obtaining acicular iron (III) oxide hydroxide particles containing Cr. The resultant particles were washed with water, filtered, dried, and ground in usual manner.

According to a chemical analysis and electromicroscopic observation, these particle were acicular $\alpha$-FeOOH particles containing 0.3 atomic % of Cr to Fe therein and having 0.5–0.6$\mu$ of long axis and 18:1 of axial ratio of long axis to short axis.

EXAMPLE 4

From 14 l of aqueous admixture consisting of $Cr_2(SO_4)_3$ aqueous solution containing 0.015 mol of Cr and $FeSO_4$ aqueous solution containing 15 mol of Fe and 6 l of 11.55-N NaOH aqueous solution, acicular iron (III) oxide hydroxide particles were prepared in accordance with the procedures employed in Example 3. The particles obtained were $\alpha$-FeOOH particles containing 0.1 atomic % of Cr to Fe therein and by electro-microscopic observation they were acicular particles having 0.5–0.6μ of long axis and 15:1 of axial ratio.

EXAMPLE 5

500g of acicular α-FeOOH particles obtained in Example 1 was heated and dehydrated at 300° C. in a stream of air to obtain acicular α-$Fe_2O_3$ particle powder. By electromicroscopic observation, they were acicular particles having 0.65–0.8μ of long axis and 12:1 of axial ratio.

EXAMPLE 6

500g of acicular α-FeOOH particles containing Cr obtained in Example 3 was heated and dehydrated at 300° C. in a stream of air to obtain acicular α-$Fe_2O_3$ particle powder containing 0.3 atomic % of Cr to Fe. By electromicroscopic observation, they were acicular particles having 0.5–0.6μ of long axis and 18:1 of axial ratio.

EXAMPLE 7

500g of acicular α-FeOOH particles obtained in Example 1 was heated and reduced at 350° C. in a stream of $H_2$ gas to form acicular magnetite particles, thereafter the magnetite were reoxidized at 270° C. in a stream of air to obtain acicular γ-$Fe_2O_3$ particle powder. By electromicroscopic observation the resultant particles were acicular particles having 0.5–0.65μ of long axis and 8:1 of axial ratio.

EXAMPLE 8

500g of acicular α-FeOOH particles containing Cr obtained in Example 3 was heated and reduced at 400° C. in a stream of $H_2$ gas to produce acicular magnetite particle containing 0.3 atomic % of Cr to Fe, therafter the magnetite were reoxidized at 300° C. in a stream of air to obtain acicular γ-$Fe_2O_3$ particle powder containing Cr. By electro-microscopic observation these were acicular particles having 0.45–0.55μ of long axis and 15:1 of axial ratio.

EXAMPLE 9

42 l of aqueous solution containing 60 mol of $FeSO_4$ and 1.6 mol of $CoSO_4$ was added into 18 l of 15.8-N NaOH aqueous solution previously placed in a reactor, while nitrogen was introduced thereinto at a flow rate of 200 l/min., then the formation of ferrous hydroxide colloid containing Co was continued for 15 minutes at pH 12.0 and at a temperature of 45° C. Air was introduced at a flow rate of 280 l/min. into the resulting colloidal solution at 50° C. to carry out oxydizing reaction for 18 hours and to thereby obtain acicular iron (III) oxide hydroxide particles containing Co. Thereafter the obtained particles were washed with water, filtered, dried, and ground in usual manner. According to a chemical analysis and electro-microscopic observation, the resultant particles were acicular α-FeOOH particles containing 2.7 atomic % of Co to Fe and having 1.0–1.2μ of long axis and 25:1 of axial ratio.

EXAMPLE 10

14 l of aqueous solution containing 20 mol of $FeSO_4$ and 1.28 mol of $CoSO_4$ was added into 6 l of 16.3-N NaOH aqueous solution previously placed in a reactor, while nitrogen was introduced thereinto at a flow rate of 100 l/min., then the formation of ferrous hydroxide colloid containing Co was continued for 10 minutes at pH 12.0 and at a temperature of 45° C. Air was introduced at a flow rate of 100 l/min. into the resulting colloidal solution at 50° C. to carry out oxydizing reaction for 18 hours and to thereby obtain acicular iron (III) oxide hydroxide particles containing Co. Thereafter the obtained particles were washed with water, filtered, dried, and ground in usual manner. According to a chemical analysis and electro-microscopic observation, the resultant particles were acicular α-FeOOH particles containing 6.4 atomic % of Co to Fe and having 0.5–0.7μ of long axis and 30:1 of axial ratio.

EXAMPLE 11

From 14 l of aqueous solution containing 20 mol of $FeSo_4$ and 0.22 mol of $CoSo_4$ and 6 l of 15.5-N NaOH aqueous solution, taking the same procedures as in Example 10, acicular iron (III) oxide hydroxide particles containing Co were prepared. The resultant particles were α-FeOOH particles containing 1.1 atomic % of Co to Fe and having 0.8–1.0μ of long axis and 20:1 of axial ratio.

EXAMPLE 12

From 14 l of aqueous solution containing 20 mol of $FeSO_4$, 0.72 mol of $CoSO_4$, and 0.12 mol of $NiSO_4$ and 6 l of 16-N NaOH aqueous solution, taking the same procedures as in Example 10, acicular iron (III) oxide hydroxide particles containing Co-Ni were prepared. The resultant particles were α-FeOOH particles containing 3.6 atomic % of Co and 0.61 atomic % of Ni to Fe and having 0.4–0.5μ of long axis and 30:1 of axial ratio.

EXAMPLE 13

20 l of 4.77-N NaOH aqueous solution was added into 30 l of aqueous solution containing 20 mol of $FeSO_4$ and 0.73 mol of $CoSO_4$. Air was introduced at a flow rate of 200 l/min. into the resulting colloidal solution of ferrous hydroxide containing Co at 45° C. to carry out oxydizing reaction for 20 hours and to thereby obtain acicular iron (III) oxide hydroxide particles containing Co. Particles thus obtained were washed with water, filtered, dried, and ground in usual manner. According to a chemical analysis, and electro-microscopic observation, the resultant particles were α-FeOOH particles containing 3.52 atomic % of Co and Fe and having 0.6–0.7μ of long axis and 15:1 of axial ratio.

EXAMPLE 14

500g of acicular α-FeOOH particles containing Co obtained in Example 13 was heated and dehydrated at 300° C. in a stream of air to produce acicular α-$Fe_2O_3$ particle powder containing 3.52 atomic % of Co to Fe. According to electro-microscopic observation the resultant particles were acicular particles having 0.5–0.6μ of long axis and 12:1 of axial ratio.

EXAMPLE 15

500g of acicular α-FeOOH particles containing Co obtained in Example 13 was heated and reduced at 350° C. in a stream of $H_2$ gas to obtain magnetite particles containing 3.52 atomic % of Co to Fe. Thereafter the obtained particles were reoxidized at 270° C. in a stream of air and to thereby obtain acicular γ-$Fe_2O_3$ particles containing Co. By electro-microscopic observation the resultant particles were acicular particles having 0.4–0.45μ of long axis and 8:1 of axial ratio.

EXAMPLE 16

14 l of aqueous solution prepared by admixing $Cr_2(SO_4)_3$ aqueous solution containing 0.062 mol of Cr with an aqueous solution containing 20 mol of $FeSO_4$ and 0.75 mol of $CoSO_4$ was added into 6 l of 16-N NaOH aqueous solution previously placed in a reactor, while introducing $N_2$ gas thereinto at a rate of 100 l/min. The procedure was continued at 45° C. and at pH 12 for 10 minutes to prepare ferrous hydroxide colloid containing Cr and Co. Thereafter air was introduced at a flow rate of 100 l/min. into the resulting colloidal aqueous solution at 50° C. to carry out oxydizing reaction for 18 hours, thereby producing acicular iron (III) oxide hydroxide particles containing Co and Cr. Subsequently, the obtained particles were washed with water, filtered, dried, and ground in usual manner.

According to a chemical analysis and electromicroscopic observation, the resultant particles were acicular α-FeOOH particles containing 3.75 atomic % of Co and 0.3 atomic % of Cr to Fe and having 0.4–0.5μ of long axis and 30:1 of an axial ratio.

EXAMPLE 17

14 l of aqueous solution prepared by admixing $Cr_2(SO_4)_3$ aqueous solution containing 0.063 mol of Cr with an aqueous solution containing 20 mol of $FeSO_4$, 0.72 mol of $CoSO_4$ and 0.12 mol of $NiSO_4$ was added into 6 l of 16-N NaOH aqueous solution previously placed in a reactor, while introducing $N_2$ gas thereinto at a rate of 100 l/min. The procedure was continued at 45° C. and at pH12 for 10 min. to prepare ferrous hydroxide colloid containing Co, Ni and Cr. Thereafter air was introduced into the resulting colloidal aqueous solution at a flow rate of 100 l/min. at 50° C. to carry out oxydizing reaction for 19 hours and to thereby obtain acicular iron (III) oxide hydroxide particles containing Co, Ni and Cr. The obtained particles were washed with water, filtered, dried, and ground in usual manner.

According to a chemical analysis and electromicroscopic observation, the resultant particles were acicular α-FeOOH particles containing 3.62 atomic % of Co, 0.60 atomic % of Ni, and 0.29 atomic % of Cr to Fe and having 0.4–0.5μ of long axis and 30:1 of axial ratio.

PREPARATION OF PARTICLES COATED WITH $SIO_2$

EXAMPLE 18

360g of acicular α-FeOOH particles obtained in Example 1 was dispersed in water to prepare 10 l of suspension. This suspension had a pH value of 7.8 and a viscosity of 4.7 poise. NaOH solution was poured into the suspension for adjusting the pH value thereof to 8.6. Thereafter 38.9 g of sodium silicate (No. 3 on J.I.S. K-1408) containing 28.55 wt % of $SiO_2$ was added into the suspension, followed by stirring and dispersing the particles while preventing oxidizing gas such as air from intermixing as far as possible. The resulting suspension had a pH value of 10.2 and a viscosity of 2.7 poise.

The obtained particles were then washed with water, filtered in usual manner and then dried at 110° C. and to thereby obtain acicular iron (III) oxide hydroxide particles coated with 4.44 mol % of $SiO_2$ based on the amount of iron therein. Accordingly, 96% of the initial sodium silicate calculated as $SiO_2$ amounts was coated on the particles. See TABLE I.

EXAMPLES 19–20

Particles coated with $SiO_2$ were produced by the same procedures employed in Example 18 except the kind of starting material particles, the pH value of the addition of sodium silicate, and the amount of sodium silicate (No. 3 on J.I.S. K-1408). The results are shown in TABLE I.

EXAMPLE 21

2880g of acicular α-FeOOH particles obtained in Example 1 was dispersed in water to produce 80 l of suspension. This suspension had a pH value of 7.5 and a viscosity of 3.8 poise. NaOH solution was added into the suspension for adjusting the pH value to 8.5, then 322g of sodium silicate (No. 3 on J.I.S. K-1408) containing 28.55 wt % of $SiO_2$ was added thereto, followed by agitating and dispersing the particles while preventing oxidizing gas such as air from intermixing as far as possible. The resultant suspension had a pH value of 10.5 and a viscosity of 2.6 poise. 1-N $H_2SO_4$ was added into the resultant suspension containing the particles coated with sodium silicate until the pH value of the suspension became 4.3 to neutralize said sodium silicate. This suspension containing the particles coated with silica was filtered and washed with water and then dried at 110° C. in usual manner and thereby to obtain acicular α-FeOOH particles containing 4.45 mol % of $SiO_2$ ($SiO_2$/Fe). Accordingly, 93% of initial water-soluble sodium silicate calculated as $SiO_2$ amounts was coated on the particles. See TABLE I.

EXAMPLES 22–23

Particles coated with $SiO_2$ were produced by the same procedures employed in Example 21 except the kind of starting material particles, concentration of the suspension, the pH value at the addition of sodium silicate, the amount of sodium silicate (No. 3 on J.I.S. K-1408) and the pH value after the neutralization.

The results are shown in TABLE I.

EXAMPLE 34

712 g of acicular α-FeOOH particles containing Co and being obtained in Example 9 was dispersed in water to prepare 10 l of suspension. This suspension had a pH value of 7.5 and a viscosity of 4.5 poise. NaOH solution was poured into the suspension for adjusting the pH value thereof to 8.5. Thereafter, 76.2 g of sodium silicate (No. 3 on J.I.S. K-1408) containing 28.55 wt % of $SiO_2$ was added into the suspension, followed by stirring and dispersing the particles while preventing oxidizing gas such as air from intermixing as far as pssible. The resulting suspension had a pH value of 10.0 and a viscosity of 2.9 poise. The obtained particles then washed with water, filtered in usual manner, and then dried at 120° C. and to thereby obtain acicular iron (III) oxide hydroxide particles containing Co coated with 4.3 mol % of $SiO_2$ based on the amount of total metal therein. Accordingly, 94% of the initial sodium silicate calculated as $SiO_2$ amounts was coated on the particles. See TABLE II.

EXAMPLES 35–36

Particles coated with $SiO_2$ were prepared by the same procedures employed in Example 34 except the kind of starting material particles, the pH value at the addition of sodium silicate, and the amount of sodium silicate (No. 3 on J.I.S. K-1408). The results are shown in TABLE II.

EXAMPLE 37

5700 g of acicular α-FeOOH particles obtained in Example 9 was dispersed in water to prepare 80 l of suspension. This suspension had a pH value of 7.6 and a viscosity of 3.5 poise. NaOH solution was poured into the suspension for adjusting the pH value to 8.3, then 632 g of sodium silicate (No. 3 on J.I.S. K-1408) containing 28.55 wt % of $SiO_2$ was added thereto, followed by agitating and dispersing the particles while preventing oxidizing gas such as air from intermixing as far as possible. The resulting suspension had a pH value of 10.2 and a viscosity of 2.9 poise. 1-N $H_2SO_4$ was poured into the resultant suspension containing the particles coated with sodium silicate at a solution temperature of 50° C. until pH 4.0 was attained thereby to neutralize said sodium silicate. This suspension containing the particles coated with silica was washed with water, filtered, and dried at 120° C. in usual and to thereby obtain acicular α-FeOOH particles containing Co and 4.5 mol % of $SiO_2$ ($SiO_2$/total metal). Accordingly, 95% of the initial water-soluble sodium silicate caluculated as $SiO_2$ amounts was coated on the particles. See TABLE II.

The concentration of Co ion in this solution was 5 ppm which was equivalent to about 1% of Co content of acicular α-FeOOH particles obtained in Example 9.

EXAMPLES 38–48

Particles coated with $SiO_2$ were prepared by the same procedures employed in Example 37 except the kind of starting material particles, the concentration of the suspension, the pH value at the addition of sodium silicate, the amount of sodium silicate (No. 3 on J.I.S. K-1408) the neutralizing temperature, and the pH value after the neutralization. The results are shown in TABLE II.

EXAMPLES 49

1140 g of acicular α-FeOOH particles containing Co and Cr and being obtained in Example 16 was dispersed in water to prepare 16 l of suspension. This suspension had a pH value of 7.5 and a viscosity of 4.5 poise.

NaOH solution was added into the suspension to attain pH 8.8. Thereafter, 126 g of sodium silicate (No. 3 on J.I.S. K-1408) containing 28.55 wt % of $SiO_2$ was added into the suspension, followed by stirring and dispersing the particles while preventing oxidizing gas such as air from intermixing as far as possible. The resulting suspension had a pH value of 10.0 and a viscosity of 2.9 poise. 1-N $H_2SO_4$ was added into the resulting suspension containing the particles coated with sodium silicate at a solution temperature of 50° C. until pH 4.8 was attained to neutralize said sodium silicate. This suspension containing the particles coated with silica was washed with water, filtered, and dried at 120° C. in usual manner and to thereby obtain acicular α-FeOOH particles containing 4.5 mol % of $SiO_2$ ($SiO_2$/total metal). Accordingly, 96% of the initial water-soluble sodium silicate calculated as $SiO_2$ amounts was coated on the particles. The result is shown in TABLE II.

EXAMPLE 50

1140 g of acicular α-FeOOH particles containing Co, Ni and Cr and being obtained in Example 17 was dispersed in water to prepare 16 of suspension. This suspension had a pH value of 7.5 and a viscosity of 4.5 poise.

NaOH solution was added into the suspension to attain pH 8.5. Thereafter, 126 g of sodium silicate (No. 3 on J.I.S. K-1408) containing 28.55 wt % of $SiO_2$ was added into the suspension, followed by stirring and dispersing the particles while preventing oxidizing gas such as air from intermixing as far as possible. The resulting suspension had a pH value of 9.5 and a viscosity of 3.0 poise.

1-N $H_2SO_4$ was added into the resulting suspension containing particles coated with sodium silicate at a solution temperature of 50° C. until pH 4.8 is attained to neutralize said sodium silicate. This suspension containing the particles coated with silicate was washed with water, filtered and dried at 120° C. in usual manner and thereby obtain acicular α-FeOOH particles containing 4.4 mol % $SiO_2$ ($SiO_2$/total metal). Accordingly, 96% of the initial water-soluble sodium silicate calculated as $SiO_2$ amounts was coated on the particles. The result is shown in TABLE II.

REDUCTION TREATMENT PROCESS

EXAMPLE 51

300 g of the resultant particle powder obtained in Example 18 was reduced in a reductor by introducing $H_2$ gas at a flow rate of 3l/min. and at 600° C. for 3 hours. The reduced acicular metallic iron were preliminarily dipped in toluene solution so as not to bring about a radical oxidation thereof when said particles were taken out in the air, thereafter, said particles were coated with stable oxidized film by evaporating said toluene from the surfaces of the particles. The physical properties of acicular magnetic iron particles thus obtained are shown TABLE III.

EXAMPLES 52–88

Acicular magnetic iron particle powder was produced by the same procedures employed in Example 51 except the kind of particles to be reduced, the reduction temperature, and the reduction time. The physical properties of the obtained particle powder are shown in TABLE III.

EXAMPLE 89

300g of the resultant particle powder obtained in Example 34 was reduced in a reductor by introducing $H_2$ gas at a flow rate of 3l/min. and at 600° C. for 4 hours. The reduced acicular Fe-Co alloy particles were preliminarily dipped in toluene solution so as not to bring about a radical oxidation thereof when said particles were taken out in the air, thereafter said particles were coated with stable oxidized film by evaporating said toluene from the surface of the particles. The physical properties of acicular magnetic Fe-Co alloy particle powder thus obtained are shown in TABLE IV.

EXAMPLES 90–120

Acicular magnetic Fe-Co or Fe-Co-Ni particle powders were obtained according to the same procedures employed in Example 89 except the kind of particles to be reduced, the reduction temperature, and the reduction time. The physical properties of the obtained particle powder are shown in TABLE IV.

EXAMPLE 121

300g of the resultant particle powder obtained in Example 49 was reduced in a reductor at 800° C. for 3 hours by introducing $H_2$ gas at a flow rate of 3l/min. The reduced acicular Fe-Co-Cr alloy particles were preliminarily dipped in toluene solution so as not to bring about a radical oxidation thereof when said particles were taken out in the air, and then after evaporation of toluene, stable oxidized film was formed on said particle surface. The physical properties of acicular magnetic Fe-Co-Cr alloy particles thus obtained are shown in TABLE IV.

EXAMPLE 122

300g of the resultant particle powder obtained in Example 50 was reduced in a reductor at 800° C. for 3 hours by introducing $H_2$ gas at a flow rate of 3l/min. The reduced acicular Fe-Co-Ni-Cr alloy particles were preliminarily dipped in toluene solution not to cause a radical oxidation thereof when said particles were taken out in the air, then after evaporation of said toluene stable oxidized film was formed on particle surface. The magnetic properties of acicular magnetic Fe-Co-Ni-Cr alloy particles thus obtained are shown in TABLE IV.

COMPARISON EXAMPLES 1-15

The resultant particles of Example 1 or 9 were reduced to acicular magnetic iron particles without coating the surface thereof with silica, by the same procedure of Example 51 except the reducing temperature and the reduction time. The physical properties of the obtained particles are shown in TABLE V.

TABLE I

| example No. | starting particle (a) | starting particle (b) | preparation of particle coated with $SiO_2$ (c) | (d) | (e) | (f) | (g) (h) | (g) (i) |
|---|---|---|---|---|---|---|---|---|
| 18 | 1 | 360/10 | 8.6 | 38.9 | 10.2 | — | 4.44 | 96 |
| 19 | 2 | " | 8.2 | 84.5 | 11.1 | — | 6.74 | 97 |
| 20 | 7 | " | 9.4 | 17.2 | 9.7 | — | 1.90 | 93 |
| 21 | 1 | 2880/80 | 8.5 | 32.2 | 10.5 | 4.3 | 4.45 | 93 |
| 22 | 1 | 360/10 | 9.0 | 13.3 | 9.8 | 4.5 | 1.44 | 91 |
| 23 | 1 | " | " | 29.5 | 10.1 | 4.3 | 3.16 | 90 |
| 24 | 1 | " | " | 55 | 9.9 | 4.5 | 6.22 | 95 |
| 25 | 1 | " | 8.8 | 74.5 | 10.5 | 3.9 | 7.88 | 89 |
| 26 | 1 | " | 9.0 | 100 | 11.6 | 4.1 | 10.35 | 87 |
| 27 | 2 | " | 8.4 | 41.2 | 9.9 | 4.3 | 4.46 | 91 |
| 28 | 3* | 1440/40 | 8.2 | 161 | 10.5 | 4.2 | 4.41 | 90 |
| 29 | 4* | 360/10 | 8.3 | 41.2 | 10.2 | 4.0 | 4.70 | 96 |
| 30 | 5 | 320/10 | 8.5 | 35.7 | 10.8 | 4.2 | 4.61 | 94 |
| 31 | 6* | " | 8.7 | " | 10.2 | 3.9 | 4.08 | 96 |
| 32 | 7 | " | 8.3 | " | 9.8 | 4.0 | 4.03 | 95 |
| 33 | 8* | " | 8.5 | " | 10.2 | 4.1 | 4.08 | 96 |

note:
*containing Cr
(a) example no.
(b) concentration (g/$H_2O$l)
(c) pH value before adding sodium silicate
(d) amount of added sodium silicate (g)
(e) pH value after adding sodium silicate
(f) pH value after neutralizing with acid
(g) particle coated with $SiO_2$
(h) $SiO_2$/Fe (mol %)
(i) $SiO_2$ coating ratio (%)

TABLE II

| example No. | starting particle (a) | starting particle (b) | preparation of particle coated with $SiO_2$ (c) | (d) | (e) | (f) | (g) | (h) (i) | (h) (j) | (h) (k) |
|---|---|---|---|---|---|---|---|---|---|---|
| 34 | 9 | 712/10 | 8.5 | 76.2 | 10.0 | — | — | 2.7 | 4.3 | 94 |
| 35 | 13 | " | 8.3 | 114.6 | 10.8 | — | — | 3.52 | 6.6 | 96 |
| 36 | 15 | " | 9.0 | 33.6 | 9.5 | — | — | " | 1.8 | 90 |
| 37 | 9 | 5700/80 | 8.3 | 632 | 10.2 | 65 | 4.0 | 2.7 | 4.5 | 93 |
| 38 | 9 | 712/10 | 8.8 | 26 | 9.5 | 55 | 4.2 | " | 1.4 | 90 |
| 39 | 9 | " | " | 58 | 9.8 | 50 | " | " | 3.1 | 89 |
| 40 | 9 | " | " | 108 | 10.6 | " | " | " | 6.0 | 93 |
| 41 | 9 | " | 9.0 | 146 | 10.9 | 45 | 3.8 | " | 7.6 | 87 |
| 42 | 9 | " | 8.9 | 231 | 11.2 | 40 | 4.3 | " | 11.9 | 86 |
| 43 | 10 | " | 8.5 | 80 | 10.5 | 50 | 4.0 | 6.4 | 4.3 | 89 |
| 44 | 11 | " | 8.3 | " | 10.3 | " | 4.1 | 1.1 | 4.2 | 88 |
| 45 | 12° | " | " | " | 10.6 | 60 | 4.2 | Co:3.6 Ni:0.61 | 4.5 | 94 |
| 46 | 13 | " | 8.5 | " | 10.7 | 50 | 3.9 | 3.52 | 4.4 | 92 |
| 47 | 14 | 640/10 | 8.9 | 70 | 10.5 | 65 | 3.8 | " | " | 94 |
| 48 | 15 | " | 8.5 | " | 10.8 | 60 | 4.0 | " | 4.5 | 96 |
| 49 | 16* | 1140/16 | 8.8 | 126 | 10.0 | 50 | 4.8 | 3.75 | " | " |
| 50 | 17*° | " | 8.5 | " | 9.5 | " | " | Co:3.62 Ni:0.60 | 4.4 | 94 |

note:
*containing Cr
°containing Ni
(a) example No.
(b) concentration (g/$H_2O$l)
(c) pH before adding sodium silicate
(d) amount of added sodium silicate (g)
(e) pH after adding sodium silicate
(f) temperature at neutralization (° C)
(g) pH after neutralizing with acid
(h) particle coated with $SiO_2$
(i) Co/Fe (atomic %)
(j) $SiO_2$/total metal (mol %)
(k) $SiO_2$ coating ratio (%) to the initial amount of $SiO_2$

TABLE III

| example No. | (a) | reducing condition (b) | reducing condition (c) | acicular magnetic iron particle: acicularity (d) | acicularity (e) | magnetic property (f) | magnetic property (g) |
|---|---|---|---|---|---|---|---|
| 51 | 18 | 600 | 3 | 0.60 | 10 | 165 | 620 |
| 52 | 19 | 650 | 4.5 | 0.55 | 10 | 150 | 700 |
| 53 | 20 | 450 | 5.5 | 0.60 | 8 | 140 | 515 |
| 54 | 21 | 450 | 4.5 | 0.8 | 13 | 120 | 518 |
| 55 | " | 500 | 3 | " | 10 | 138 | 566 |
| 56 | " | 650 | 2 | 0.65 | 8 | 156 | 700 |
| 57 | " | 700 | 1.5 | 0.5 | 5 | 165 | 685 |
| 58 | 28* | 450 | 4.5 | 0.6 | 17 | 125 | 512 |

TABLE III-continued

| example No. | (a) | reducing condition (b) | (c) | acicular magnetic iron particle: acicularity (d) | (e) | magnetic property (f) | (g) |
|---|---|---|---|---|---|---|---|
| 59 | " | 500 | 3 | " | 15 | 130 | 623 |
| 60 | " | 650 | 2 | " | 15 | 150 | 750 |
| 61 | " | 800 | 2 | 0.5 | 12 | 164 | 840 |
| 62 | 21 | 400 | 5 | 0.8 | 12 | 124 | 505 |
| 63 | " | " | 6 | 0.65 | 10 | 126 | 520 |
| 64 | " | " | 8 | 0.6 | " | 129 | 520 |
| 65 | " | 450 | 2 | 0.8 | 12 | 135 | 550 |
| 66 | " | " | 4 | 0.65 | 10 | 146 | 630 |
| 67 | " | " | 6 | 0.6 | 8 | 149 | 670 |
| 68 | " | " | 8 | " | " | 152 | 690 |
| 69 | " | 600 | 1 | 0.7 | 10 | 132 | 550 |
| 70 | " | " | 4 | 0.6 | 8 | 162 | 800 |
| 71 | " | " | 6 | 0.5 | 7 | 168 | 820 |
| 72 | 22 | " | 2 | 0.55 | 8 | 157 | 653 |
| 73 | 23 | " | " | 0.7 | 10 | 154 | 890 |
| 74 | 24 | 600 | 2 | 0.7 | 13 | 143 | 805 |
| 75 | 25 | " | " | 1.0 | 15 | 135 | 698 |
| 76 | 26 | " | " | " | " | 123 | 625 |
| 77 | 22 | " | 6 | 0.5 | 6 | 178 | 512 |
| 78 | 23 | " | " | 0.6 | 8 | 175 | 730 |
| 79 | 24 | " | " | 0.7 | 13 | 166 | 1075 |
| 80 | 25 | " | " | " | 15 | 159 | 1200 |
| 81 | 26 | " | " | 0.8 | " | 150 | 1195 |
| 82 | 27 | 650 | 4 | 0.5 | 8 | 155 | 610 |
| 83 | 28* | " | " | 0.6 | 15 | 164 | 830 |
| 84 | 29* | " | " | 0.45 | 13 | 165 | 850 |
| 85 | 30 | " | " | 0.55 | 8 | 168 | 745 |
| 86 | 31* | " | " | 0.55 | 15 | 170 | 863 |
| 87 | 32 | " | " | 0.5 | 8 | 165 | 720 |
| 88 | 33* | " | " | 0.5 | 15 | 176 | 874 |

note:
*containing Cr
(a) particle coated with $SiO_2$ (example No.)
(b) temperature (° C)
(c) time (hour)
(d) long axis (μ)
(e) long axis/short axis
(f) saturated magnetic flux density δs (emu/g)
(g) coercive force Hc (Oe)

TABLE IV

| example No. | (a) | reducing condition (b) | (c) | acicular magnetic Fe-Co alloy particle: acicularity (d) | (e) | magnetic property (f) | (g) |
|---|---|---|---|---|---|---|---|
| 89 | 34 | 600 | 4 | 0.7 | 12 | 140 | 1220 |
| 90 | 35 | 650 | 6 | 0.6 | 15 | 155 | 1410 |
| 91 | 36 | 450 | 8 | 0.6 | 10 | 130 | 1100 |
| 92 | 37 | 450 | " | 0.8 | 13 | 108 | 630 |
| 93 | " | 500 | " | " | " | 125 | 848 |
| 94 | " | 600 | " | 0.6 | 11 | 150 | 1225 |
| 95 | " | 650 | " | " | " | 160 | 1300 |
| 96 | " | 700 | " | " | 10 | 173 | 1285 |
| 97 | " | 800 | " | 0.5 | 7 | 185 | 1010 |
| 98 | 37 | 400 | 4 | 1.0 | 15 | 103 | 540 |
| 99 | " | " | 6 | 0.8 | " | 109 | 647 |
| 100 | " | " | 8 | " | 13 | 114 | 685 |
| 101 | " | " | 4 | 0.8 | 13 | 138 | 1020 |
| 102 | " | " | 6 | " | " | 143 | 1080 |
| 103 | " | " | 8 | 0.7 | " | 145 | 1100 |
| 104 | " | 650 | 0.5 | 0.8 | 13 | 125 | 875 |
| 105 | " | " | 4 | 0.6 | 10 | 170 | 1450 |
| 106 | " | " | 6 | 0.5 | 10 | 172 | 1490 |
| 107 | 39 | " | " | 0.8 | 12 | 175 | 1000 |
| 108 | 40 | " | " | " | 15 | 138 | 1200 |
| 109 | 41 | " | " | 1.0 | 18 | 120 | 800 |
| 110 | 42 | " | " | " | " | 105 | 590 |
| 111 | 39 | " | " | 0.6 | 8 | 180 | 800 |
| 112 | 40 | " | " | 0.7 | 13 | 184 | 1190 |
| 113 | 41 | 650 | 6 | 0.7 | 15 | 185 | 1480 |
| 114 | 42 | " | " | 0.8 | " | 144 | 1250 |
| 115 | 43 | 650 | 4 | 0.4 | 15 | 165 | 1380 |
| 116 | 44 | " | " | 0.6 | 12 | 145 | 1350 |
| 117 | 45* | " | " | 0.35 | 13 | 173 | 1460 |
| 118 | 46 | " | " | 0.4 | 10 | 155 | 1400 |
| 119 | 47 | " | " | " | 12 | 166 | 1420 |
| 120 | 48 | " | " | 0.35 | 10 | 170 | 1450 |
| 121 | 49* | 800 | 3 | .35–0.4 | 15 | 176 | 1700 |

TABLE IV-continued

| example No. | (a) | reducing condition (b) | (c) | acicular magnetic Fe-Co alloy particle: acicularity (d) | (e) | magnetic property (f) | (g) |
|---|---|---|---|---|---|---|---|
| 122 | 50*° | " | " | " | 13 | 180 | 1500 |

note:
*containing Cr
° containing Ni
(a) particle coated with $SiO_2$ (example No.)
(b) temperature (° C)
(c) time (hour)
(d) long axis (μ)
(e) long axis/short axis
(f) saturated magnetic flux density δs (emμ/g)
(g) coercive force Hc (Oe)

TABLE V

| comparison example No. | (a) | reducing condition (b) | (c) | acicular magnetic iron or Fe-Co alloy particle: acicularity (d) | (e) | magnetic property (f) | (g) |
|---|---|---|---|---|---|---|---|
| 1 | 1 | 350 | 2 | 0.65 | 8 | 95 | 425 |
| 2 | " | 400 | " | 0.5 | " | 116 | 350 |
| 3 | " | 450 | " | 0.35 | 5 | 131 | 275 |
| 4 | " | 500 | " | 0.3 | 3 | 154 | 200 |
| 5 | 9 | 330 | " | 1.0 | 15 | 91 | 430 |
| 6 | " | 400 | " | 0.6 | 8 | 115 | 375 |
| 7 | " | 450 | " | 0.3 | 5 | 132 | 280 |
| 8 | " | 500 | " | " | 3 | 155 | 225 |
| 9 | " | 330 | " | 1.0 | 15 | 85 | 350 |
| 10 | " | " | 4 | 0.8 | 13 | 96 | 500 |
| 11 | " | " | 6 | " | " | 99 | 530 |
| 12 | " | " | 8 | 0.6 | 10 | 103 | 555 |
| 13 | " | " | 10 | " | " | 103 | 580 |
| 14 | " | " | 12 | 0.5 | 8 | 107 | 575 |
| 15 | " | " | 14 | " | 6 | 110 | 520 |

note:
(a) starting particle (example No.)
(b) temperature (° C)
(c) time (hour)
(d) long axis (μ)
(e) long axis/short axis
(f) saturated magnetic flux density δs (emu/g)
(g) coercive force Hc (Oe)

What is claimed is:

1. A process for producing acicular magnetic metallic particles comprising the steps of:

preparing an aqueous suspension of at least one acicular metal oxide particles as starting material selected from the group consisting of acicular ferric oxide particles, acicular iron (III) oxide hydroxide particles and each of these ones containing Co and/or Ni while adjusting the pH of the suspension at a value higher than 8;

adding an amorphous water-soluble silicate into the suspension as fully agitated under non-oxidizing atmosphere so as to prevent the hydrolytic and oxidative decomposition of the amorphous silicate in the suspension into crystalline silica through this step while the pH of the suspension is in the range of 8–12, thereby providing homogeneous and dense coats of amorphous silicate on the acicular metal oxide particles;

converting the resultant amorphous silicate coats on the particles into the crystalline silica coats by water-washing or neutralization with acid; and thereafter heating the particles in a stream of reducing gas at a temperature between 400°–800° C. and to thereby obtain acicular magnetic metallic particles.

2. The process of claim 1 in which the acicular metal oxide particles as starting material are obtained by adding into a ferrous salt solution an alkali in an amount more than the stoichiometrically equivalent of the ferrous salt at a temperature between 40°-55° C. under non-oxidizing atmosphere to thereby obtain a solution having a pH of higher than 11 and containing a ferrous hydroxide precipitate therein, oxidizing said ferrous hydroxide precipitate by introducing an oxidizing gas into the resultant solution as maintained at a temperature lower than 50° C., and thereafter water-washing, collecting and drying the resultant particles of acicular metal oxide.

3. The process of claim 2 in which the acicular metal oxide includes 0.01-1 atomic % of Cr based on the amount of Fe component therein.

4. The process of claim 3 in which the acicular metal oxide includes 0.1-10 atomic % of Co and/or Ni based on the amount of Fe component therein.

5. The process of claim 1 in which the amount of amorphous water-soluble silicate added into the suspension is 1 to 15 mol % calculated as the amount of $SiO_2$ based on the amount of the total metal therein.

6. The process of claim 1 in which the heating temperature in the reducing gas is in the range of 450°-700° C.

7. The process of claim 1 in which the resultant amorphous silicate on the particles is neutralized by an acid at a temperature between 20°-80° C., said particles being ferric oxide containing Co and/or Ni or iron (III) oxide hydroxide containing Co and/or Ni.

* * * * *